US011285397B2

(12) United States Patent
Penney et al.

(10) Patent No.: US 11,285,397 B2
(45) Date of Patent: Mar. 29, 2022

(54) PRINTED MOLDABLE MATERIAL

(71) Applicant: Hasbro, Inc., Pawtucket, RI (US)

(72) Inventors: Jill Renee Penney, Pawtucket, RI (US); Roger Paul Cazeault, Jr., North Scituate, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 16/845,590

(22) Filed: Apr. 10, 2020

(65) Prior Publication Data

US 2020/0330890 A1 Oct. 22, 2020

Related U.S. Application Data

(60) Provisional application No. 62/834,481, filed on Apr. 16, 2019.

(51) Int. Cl.
*A63H 33/00* (2006.01)

(52) U.S. Cl.
CPC ..... *A63H 33/001* (2013.01)

(58) Field of Classification Search
CPC ..... A63H 33/001; Y10S 425/057
USPC ..... 446/85, 491; 425/DIG. 57
See application file for complete search history.

(56) References Cited

U.S. PATENT DOCUMENTS 2,485,323 A 10/1949 Schwartz
2,831,286 A * 4/1958 Eisner ..... B44C 3/04 249/112
3,552,711 A * 1/1971 DeLaney ..... A63H 33/001 249/170
3,685,936 A * 8/1972 Meth ..... A63H 33/001 425/192 R
3,808,730 A * 5/1974 Cooper ..... A63H 33/3055 446/481
3,920,368 A * 11/1975 Lemelson ..... A63H 33/001 425/195
3,921,801 A * 11/1975 Sway ..... B65D 81/366 206/575
3,975,480 A * 8/1976 Walters ..... A63H 33/001 264/113
4,076,476 A * 2/1978 Ventura ..... A63H 33/001 425/183
4,496,510 A * 1/1985 Hanson ..... A63H 33/22 264/246

(Continued)

FOREIGN PATENT DOCUMENTS

JP 57-99980 A 6/1982
KR 200325618 Y1 9/2003

OTHER PUBLICATIONS

Bahng Seung Hoon, Korean Intellectual Property Office, International Search Report and Written Opinion, corresponding PCT Application No. PCT/US2020/027656, dated Jul. 28, 2020, 14 pages total.

*Primary Examiner* — Alexander R Niconovich
(74) *Attorney, Agent, or Firm* — DiBerardino McGovern IP Group LLC

(57) ABSTRACT

A toy set includes: a first base portion including a first recessed region having a first depth; and a second base portion including a design region, the design region including one or more design formation devices, each of the one or more design formation devices including a design projection extending from the second base portion to a second height that is less than the first depth.

34 Claims, 9 Drawing Sheets

(56) References Cited

U.S. PATENT DOCUMENTS 4,569,815 A * 2/1986 Rentz ..... A63H 33/001 264/310
4,815,961 A * 3/1989 Kindred ..... A63H 33/001 425/376.1
4,988,321 A * 1/1991 Goldfarb ..... A63H 33/001 434/159
4,993,932 A * 2/1991 D'Andrade ..... A63H 33/001 425/154
5,240,255 A * 8/1993 Barlow ..... A63F 3/00697 273/243
5,306,192 A * 4/1994 Caveza ..... A63H 33/3055 426/104
5,314,373 A * 5/1994 Caveza ..... A63H 33/3055 446/475
5,346,423 A * 9/1994 Caveza ..... A63H 33/3055 426/104
5,387,149 A * 2/1995 Caveza ..... A21C 9/06 100/137
5,413,472 A * 5/1995 Dietterich ..... A63H 33/001 249/102
5,427,528 A * 6/1995 Anderson ..... A63H 33/001 434/81
5,480,335 A * 1/1996 Caveza ..... A63H 33/001 426/104
5,534,281 A * 7/1996 Pappas ..... A21C 9/04 101/169
5,562,927 A * 10/1996 Masuda ..... C11D 13/16 425/98
5,855,952 A * 1/1999 Uchida ..... B22F 10/10 427/180
5,954,561 A * 9/1999 Cannone ..... A63H 33/3055 446/75
6,589,096 B1 * 7/2003 Doane, Jr ..... A63H 9/00 446/385
6,602,066 B1 * 8/2003 Heayes ..... A63H 33/32 425/382.3
6,672,189 B1 * 1/2004 Aiken ..... A63H 33/001 83/284
8,689,685 B2 4/2014 Lawrence
8,882,488 B2 * 11/2014 Schultheis ..... A63H 33/001 425/332
9,044,026 B2 6/2015 Bakhoum
9,687,752 B2 * 6/2017 Clark ..... A63H 33/32
9,883,678 B2 * 2/2018 Mueller ..... A21C 15/005
10,220,324 B1 * 3/2019 Shoaff ..... A63H 3/20
2003/0088025 A1 * 5/2003 Ogawa ..... C08L 61/14 525/107
2009/0309251 A1 * 12/2009 DuFaux ..... B29C 48/02 264/75
2012/0114812 A1 * 5/2012 Lawrence ..... B30B 15/062 426/231
2014/0370150 A1 * 12/2014 Bakhoum ..... A21C 11/12 426/19
2014/0378026 A1 * 12/2014 Foster ..... A63H 33/001 446/448
2018/0001221 A1 * 1/2018 You ..... A63H 33/001

* cited by examiner

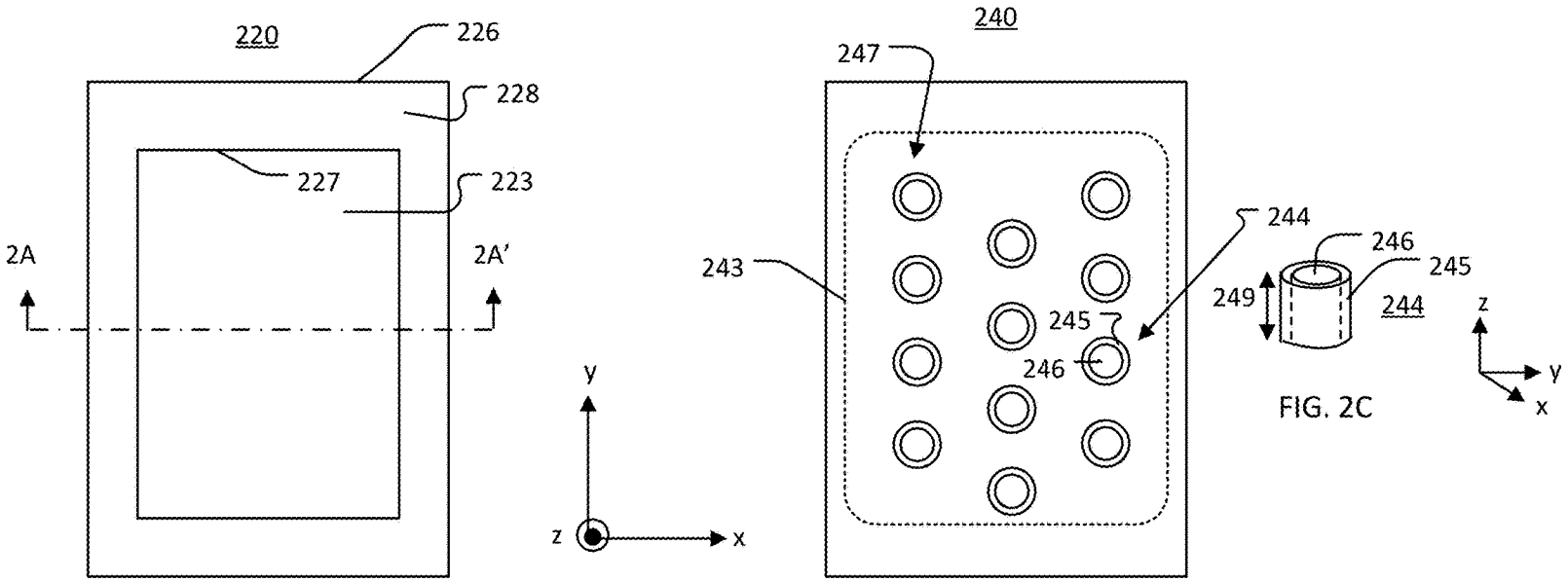
FIG. 2A
FIG. 2B
FIG. 2C
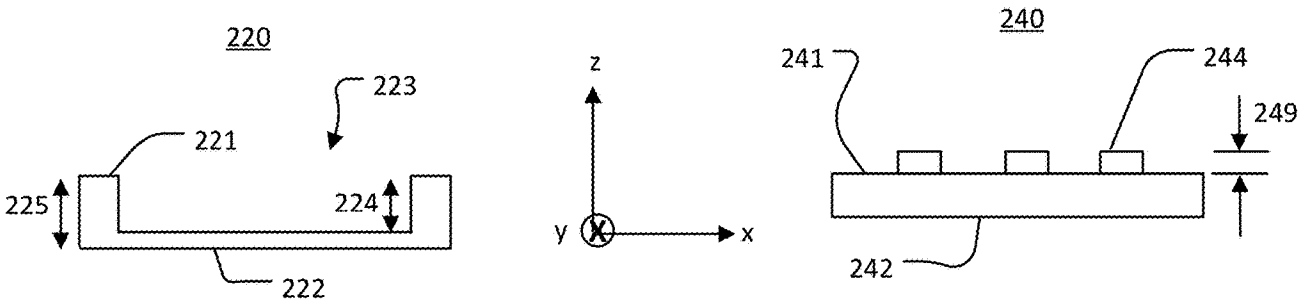
FIG. 2E
FIG. 2D

PRINTED MOLDABLE MATERIAL

CROSS-REFERENCE TO RELATED APPLICATION

This application claims the benefit of U.S. Provisional Application No. 62/834,481, filed on Apr. 16, 2019, and titled PRINTED MOLDABLE MATERIAL, which is incorporated herein by reference in its entirety.

TECHNICAL FIELD

This disclosure relates to a printed moldable material and a toy set for making a printed moldable material.

BACKGROUND

Persons of all ages enjoy playing and interacting with toys.

SUMMARY

In one aspect, a toy set includes: a first base portion including a first recessed region having a first depth; and a second base portion including a design region, the design region including one or more design formation devices, each of the one or more design formation devices including a design projection extending from the second base portion to a second height that is less than the first depth.

Implementations may include one or more of the following features. In some implementations, the second height is no more than half of the first depth.

The toy set also may include a pressing assembly configured to: press a first moldable material into the first recessed region, press a second moldable material into the design region, and to press the first base portion and the second base portion together. The pressing assembly may include a rigid cylindrical body configured to rotate about a longitudinal axis of the body. The pressing assembly may include a support; and a first roller configured to rotate relative to the support. The first roller may be mounted to the support. The pressing assembly also may include a lever connected to the first roller, and the roller may rotate relative to the support in response to a force applied to the lever. The lever may move in response to the applied force, and the pressing assembly also may include a second roller and a gear assembly configured to transfer the motion of the lever to the first roller and the second roller. The first roller and the support may be separated such that the first base portion or the second base portion fits between the first roller and the support. The first roller and the support may be separated such that the first base portion and the second base portion fit between the first roller and the support at the same time. The first roller and the second roller may be arranged such that the first base portion and a third base portion, or the second base portion and the third base portion fit between the first roller and the second roller. The first roller and the second roller may be arranged such that the first base portion and the second base portion fits between the first roller and the second roller at the same time. The toy set also may include a third base portion configured for placement between the support and one of the first base portion and the second base portion.

The toy set also may include the first moldable material and the second moldable material.

The design region may include more than one design formation device. All of the design projections may have the same shape. The design formation devices may be arranged in a regular pattern. The regular pattern may be a rectangular grid.

The recessed region may include a lip portion configured to allow the first moldable material to be removed from the recessed region after the first moldable material is pressed into the recessed region.

The first base portion may be a first plate that includes a first side and a second side, and the first recessed region may be on the first side of the first plate; and the second base portion may be a second plate including a first side and a second side, and the design region may be on the first side of the second plate. The first side of the first plate and the second side of the second plate may be configured to be pressed toward each other.

In another aspect, a method of creating a printed moldable material includes: pressing a first moldable material into a recessed region of a first base portion to form a pressed first moldable material; pressing a second moldable material into a design region of a second base portion to form a pressed second moldable material having a shape of the design region; pressing the design region of the second base portion and the pressed first moldable material together; and creating the printable moldable material by separating the pressed first moldable material and the design region such that the pressed second moldable material having the shape of the design region is transferred to the pressed first moldable material.

Implementations may include one or more of the following features. The shape of the design region may include a plurality of spatially distinct design elements, a plurality of spatially distinct pieces of the second moldable material may be transferred to the pressed first moldable material, and each of the plurality of spatially distinct pieces of the second moldable material may have a shape determined by a respective one of the design elements. Pressing the design region into the pressed first moldable material may include pressing the second base portion and the first base portion together. In some implementations, before pressing the first base portion and the second base portion together, the method also includes: removing excess first moldable material from the first base portion, the excess first moldable material being any of the first moldable material that is not in the recessed region; and removing excess second moldable material from the second base portion, the excess second moldable material being any of the second moldable material that is not in the design region.

The first base portion may include a first plate that includes a first side and a second side opposite the first side; the second base portion may include a second plate that includes a first side and a second side opposite the first side; and pressing the first base portion and the second base portion together may include: positioning the first base portion and the second base portion with the first side of the first base portion facing the first side of the second base portion; and applying pressure to one or more of the second side of the first base portion and the second side of the second base portion. In some implementations, after positioning the first base portion and the second base portion, the first base portion and the second base portion are positioned between a roller and a platform with the second side of the first base portion or the second side of the second base portion on the platform.

In another aspect, a toy set includes: a first base portion including a recess having a first depth; a second base portion including a design region, the design region including a design region, the design region including one or more design formation devices, each of the one or more design formation devices including a design projection extending from the second base portion to a second height that is less than the first depth; a third base portion; a first moldable material; a second moldable material; and a pressing assembly including: a platform; a first roller; and a second roller at the platform. The second roller and the first roller are separated; the first base portion and the third base portion, the second base portion and the third base portion, or the first base portion and the second base portion are configured to stack together to form a stack; and the stack fits between the first roller and the second roller while touching the first roller and the second roller.

In another aspect, a system includes: a substantially planar substrate with a thickness, the substantially planar substrate including a first moldable material; a design formation device including: a base portion; and a plurality of design formation projections that extend from the base portion to a first height, each design formation projection including a cutting edge and an open space; a material supply configured to provide a second moldable material to the design formation device to thereby capture a segment of the second moldable material in the open space of at least one design formation projection. The thickness of the substrate is less than the first height, and an interaction between at least one design formation projection and the substrate transfers the segment of the second moldable material in the open space to the substrate.

Implementations may include one or more of the following features.

The material supply may be configured to hold the second moldable material and to place the second moldable material in contact with the design formation device.

The base portion may be a cylinder, and the plurality of design formation projections may extend from an outer surface of the cylinder. The system also may include an additional material supply configured to hold the first moldable material. The additional material supply may be further configured to shape the first moldable material into the substantially planar substrate.

In some implementations, the system also includes a driving device coupled to the design formation device, the driving device configured to cause the interaction between at least one design formation projection and the substrate. The driving device may be a motor.

In another aspect, a method of making a printed moldable material includes: providing a substrate including a first moldable material; interacting a design formation device with a second moldable material to capture a segment of the second moldable material in an open space of at least one design formation projection of the design formation device; and placing the segment in physical contact with the substrate to thereby produce a printed moldable material that includes the substrate and the segments of the second moldable material.

Implementations may include one or more of the following features.

The method also may include forming the substrate.

The method also may include applying pressure to the transferred segment to press the transferred segment into the substrate.

Implementations of any of the techniques described above can include a toy set, a printed moldable material, and/or a method. The details of one or more implementations are set forth in the accompanying drawings and the description below. Other features will be apparent from the description and drawings, and from the claims.

DRAWING DESCRIPTION

FIG. 2A is a block diagram of an example of a first base portion.

FIG. 2B is a block diagram of an example of a second base portion.

FIG. 2C is a perspective view of an example of a design formation device.

FIG. 2D is a side cross-sectional view of the first base portion of FIG. 2A taken along line 2A-2A' of FIG. 2A.

FIG. 2E is a side view of the second base portion of FIG. 2B.

DESCRIPTION

Figure 1:
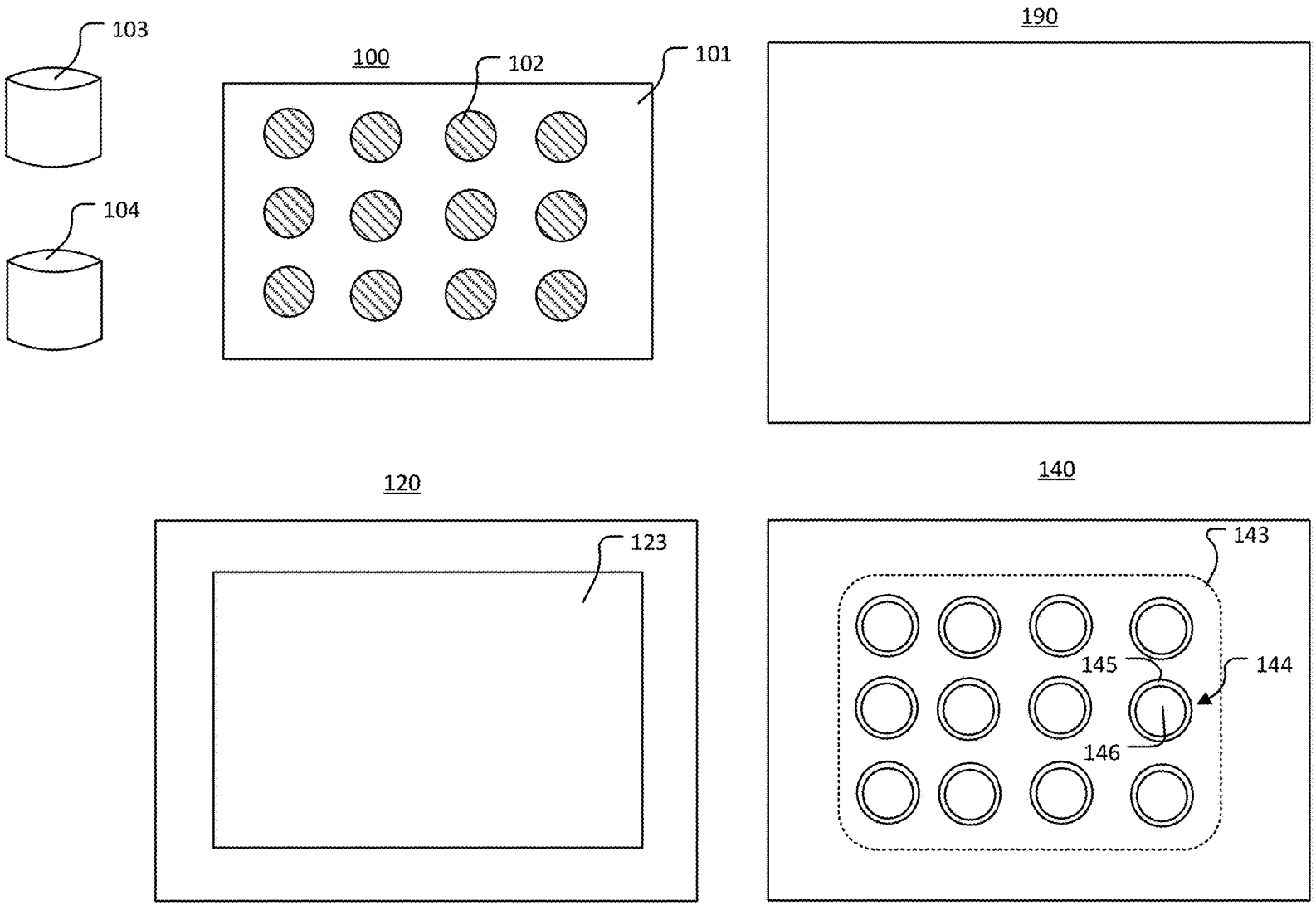
FIG. 1 shows an example of a printed moldable material and an example of a toy set.

Referring to FIG. 1, a printed moldable material 100 is shown. The printed moldable material 100 includes a substrate 101 and design elements 102. The substrate 101 is a flattened piece of a first moldable material 103. The design elements 102 are distinct pieces of a second moldable material 104 that adhere to the flattened first moldable material 103. In the example of FIG. 1, the design elements 102 are shown with striped shading.

The first moldable material 103 and the second moldable material 104 may be any type of material that is capable of being shaped and capable of holding a shape. For example, the first moldable material 103 and the second moldable material 104 may be putty, clay, and/or a dough substance (for example, PLAY-DOH®, available from Hasbro, Inc. of Pawtucket, R.I.). The first moldable material 103 and the second moldable material 104 may be the same type of moldable material. For example, the first moldable material 103 and the second moldable material 104 may be PLAY-DOH. In these implementations, the first moldable material 103 may be PLAY-DOH of a first color and the second moldable material 104 may be PLAY-DOH of a second color that is visually distinguishable from the first color. In other implementations, the first moldable material 103 and the second moldable material 104 may be first and second pieces that are separated from a larger piece of PLAY-DOH. In these implementations, the first moldable material 103 and the second moldable material 104 are the same color. Other implementations are possible. For example, the first moldable material 103 may be a different type of moldable material than the second moldable material 104.

The substrate 101 is formed by pressing the first moldable material 103 into a recess 123 of a first base portion 120. The design elements 102 are formed by pressing the second moldable material 104 into a design region 143 of a second base portion 140. In the example of FIG. 1, a dashed boundary shows the design region 143. The dashed boundary is not a physical aspect of the second base portion 140 and is only included to illustrate the design region 143. The design region 143 includes a plurality of design projections 144 that each include a cutting edge 145 that surrounds an open space 146. Only one of the design projections or design formation devices 144 is labeled for simplicity. The cutting edge 145 is configured to pass through the second moldable material 104, and individual pieces of the moldable material 104 are temporarily retained in the open space 146.

The first base portion 120 and the second base portion 140 are then pressed together such that the first moldable material 103 in the recess 123 of the first base portion 120 and the second moldable material 104 in the design region 143 of the second base portion 140 make physical contact. The design elements 102 stick to the substrate 101 and are transferred from the second base portion 140 to the substrate 101. Examples of the first base portion 120 and the second base portion 140 are discussed below.

The first base portion 120 and the second base portion 140 may be sold as a toy set. The toy set also may include the first moldable material 103 and the second moldable material 104. The toy set also may include a third base portion 190. The third base portion 190 may be a solid plate structure that does not include a recess or a design portion but is the same extent in the x-y plane as the first and second base portions 120, 140.

FIG. 2A is a block diagram of a first base portion 220 in the x-y plane. FIG. 2B is a block diagram of a second base portion 240 in the x-y plane. FIG. 2C is a perspective view of a design formation device 244. FIG. 2D a side cross-sectional view of the first base portion 220 taken along line 2A-2A' (FIG. 2A). FIG. 2E is a side view of the second base portion 240. The first base portion 220 and the second base portion 240 are made from a solid and durable material that has a fixed shape. For example, the first base portion 220 and the second base portion 240 may be made of molded plastic. The first base portion 220 and the second base portion 240 may be part of a toy set.

The first base portion 220 includes a first side 221 and a second side 222 opposite the first side 221. The first base portion 220 is a plate structure that extends in the x-y plane to a perimeter 226. The first base portion 220 has a thickness or extent 225 in the z direction at the perimeter 226. A recess 223 is formed on the first side 221. The recess 223 extends into the first base portion 220 in the −z direction to a first depth 224. The first depth 224 is less than the thickness 225. The recess 223 does not pass through the first base portion 220. The recessed region 223 has a perimeter 227 in the x-y plane. The perimeter 227 is within the perimeter 226. The portion of the side 221 that is between the perimeter 226 and the perimeter 227 is a flat region and is labeled 228. In the example of FIG. 2A, the perimeter 226 and the perimeter 227 have rectangular shapes.

The second base portion 240 includes a first side 241 and a second side 242 opposite the first side 241. The first side 241 of the second base portion 240 includes a design region 243. The design region 243 is illustrated with a dashed line in FIG. 2B. The dashed line does not represent a physical boundary on the first side 241. Instead, the dashed line illustrates that the design region 243 is a portion of the first side 241 that includes a plurality of design formation devices 244. For simplicity, only one of the plurality of design formation devices 244 is labeled.

Each design formation device 244 includes a cutting edge 245. Only one cutting edge 245 is labeled in FIG. 2B. The cutting edge 245 extends from the first side 241 in the z direction to a distance 249. The distance 249 also is referred to as the height of the cutting edge 245. The cutting edge 245 and a portion of the first side 241 that is surrounded by the cutting edge 245 define an open space 246. The open space 246 has a volume that is determined by the height 249 and the area encircled by the cutting edge 245 in the x-y plane. The volume of the open space 246 determines the maximum amount of the moldable material that can be held in the open space 246. In other words, the open space 246 may hold a volume of the moldable material that is determined by the height 249 and the diameter of the cutting edge 245. When the open space 246 has a cylinder shape (as in FIGS. 2B and 2C), the volume of the open space 246 is determined by the equation for the volume of a cylinder, which is $(h\pi)r^2$, where h is the height 249 and r is the radiation of the area encircled by the cutting edge 245 in the x-y plane.

The height 249 is less than the first depth 224. For example, the height 249 may be a half or less of the first depth 224. Thus, in implementations in which the first depth 224 is 2 millimeters (mm), the height 249 may be 1 mm or less. In implementations in which the first depth 224 is 3 millimeters (mm), the height 249 may be 1.5 mm or less.

The cutting edge 245 is made of a durable material that is capable of cutting through moldable material. The cutting edge 245 may be made of, for example, a molded plastic material. The cutting edge 245 may be made of the same material as the second base portion 240. The second base portion 240 and the design formation devices 244 may be integrally formed. For example, the second base portion 240 and the design formation devices 244 may be a single piece of molded plastic.

In the example of FIG. 2B, all of the cutting edges 245 are the same, and cutting edge 245 is a cylinder that defines the open region 246. The cutting edges 245 of FIG. 2B have a ring shape in the x-y plane. In other implementations, the cutting edges 245 all have the same height 249 but have different shapes in the x-y plane. For example, in some implementations, some of the cutting edges 245 have a ring shape in the x-y, other of the cutting edges 245 have star shape in the x-y plane, and still other of the cutting edges 245 have a heart shape in the x-y plane.

The design formation devices 244 are arranged in the design region 243. In the example of FIG. 2B, the design region 243 includes twelve (12) design formation devices 244. The design formation devices 244 are arranged in three groups 247. Each group 247 includes four design formation devices 244 separated from each other and arranged in a line in the y direction. The groups 247 are separated from each other in the x direction. Additionally, the design formation devices 244 in a group 247 are staggered or displaced along the y direction compared to the design formation devices 244 in the adjacent group or groups 247. The arrangement of the design formation devices 244 shown in FIG. 2B is an example. Other arrangements are possible. For example, the design formation devices 244 may be arranged as shown in FIG. 1.

Figure 3:
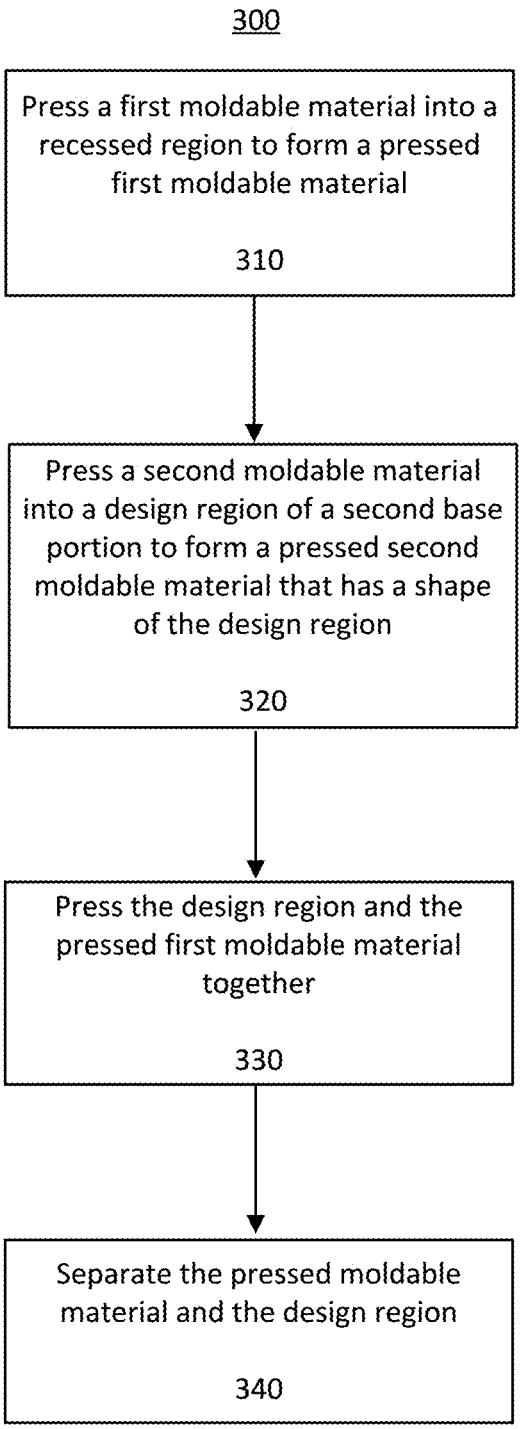
FIG. 3 is a flow chart of an example of a process for creating a printed moldable material.

Referring to FIG. 3, a flow chart of a process 300 is shown. The process 300 is an example of a process for creating a printed moldable material (such as the printed moldable material 100 shown in FIG. 1). The process 300 is discussed with reference to the first base portion 220 and the second base portion 240 of FIGS. 2A-2E. However, the discussion below is provided only as an example. The process 300 may be performed with other base portions, such as the first base portion 120 and the second base portion 140 of FIG. 1.

The first moldable material 103 is pressed into the recess 223 (310). For example, the first moldable material 103 may initially be a sphere of moldable material that is placed in the recess 223 and flattened by pressing on the material 103 in the −z direction so that the material 103 spreads out in the x-y plane and fills the recess 223. The material 103 may be flattened using any approach that applies pressure to the material. For example, the user may flatten the material 103 using their hand. In some implementations and referring to FIGS. 4 and 5, a pressing assembly is used to flatten the material 103 into the recess 223. The pressing assembly may be any type of device that is capable of applying pressure to the material 103 in response to user manipulation.

Figure 4:
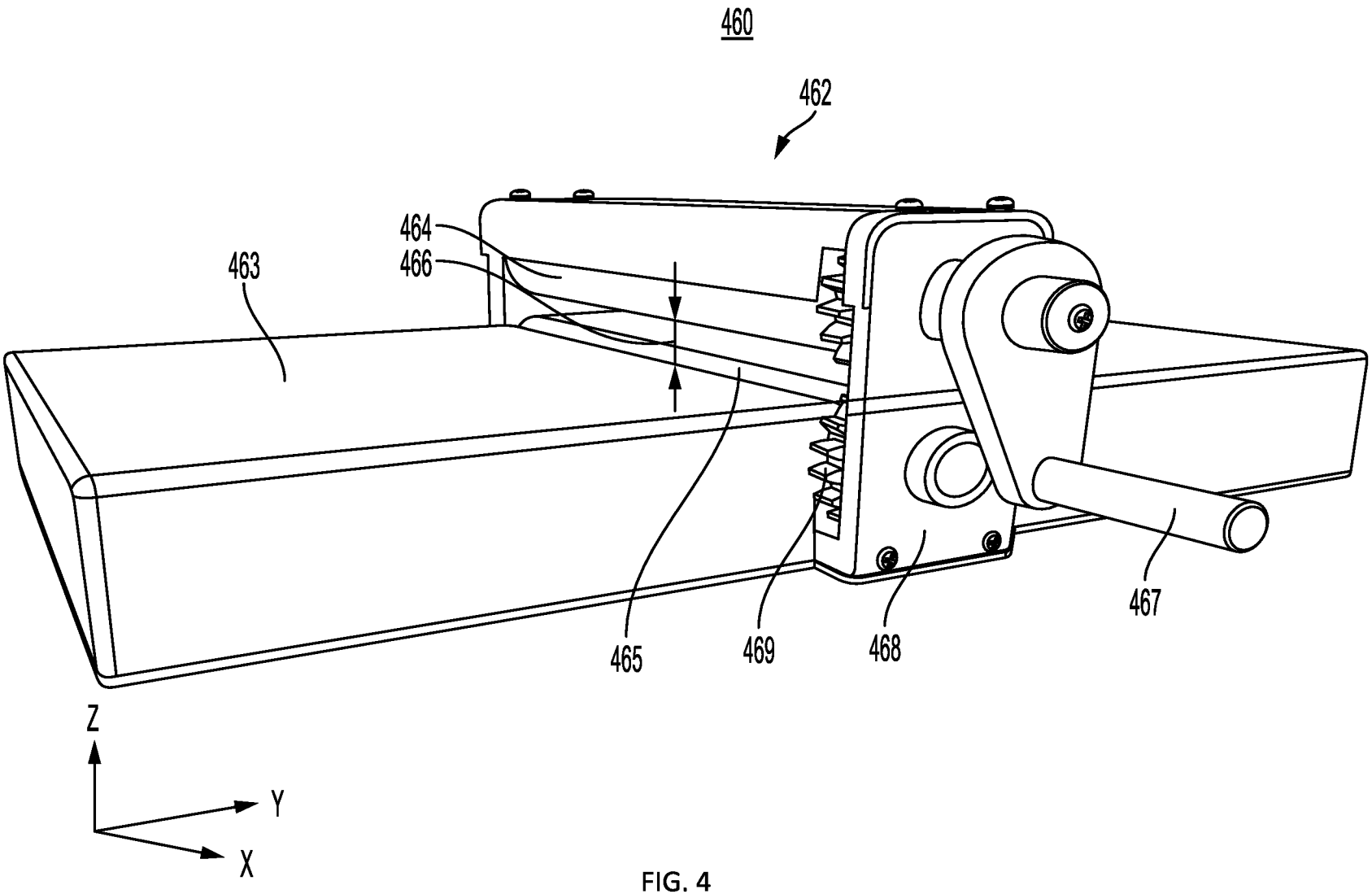
FIGS. 4 and 5 are perspective views of examples of pressing assemblies.

FIG. 4 is a perspective view of a pressing assembly 460. The pressing assembly 460 includes a pressing portion 462 that is mounted to a platform 463. The platform 463 is a sturdy object that is substantially flat in the x-y plane. The pressing portion 462 includes a first roller 464 and a second roller 465 that are separated by a separation distance 466 along the z direction. The first roller 464 and the second roller 465 are rigid cylindrical objects, and the second roller 465 protrudes from the platform 463. Each of the first roller 464 and the second roller 465 has a longitudinal axis that extends along the x direction. The first roller 464 and the second roller 465 are mounted to a roller support 468 that is secured to the platform 463. The roller support 468 holds the first roller 464 and the second roller 465 in a fixed spatial relationship with the platform 463 while allowing the rollers 464 and 465 to rotate relative to the platform 463. In other words, the rollers 464 and 465 do not translate along the x, y, or z directions relative to the platform 463 but are able to rotate about the x direction and relative to the platform 463.

The first roller 464 is attached to a crank 467 that moves in response to the application of force. In the example of FIG. 4, the crank 467 moves clockwise or counterclockwise about the x axis in response to user manipulation. The crank 467 is coupled to a gear assembly 469, which is attached to the first roller 464 and the second roller 465. The gear assembly 469 includes one or more gears that move in response to force being applied to the crank 467. Thus, when the crank 467 moves, the gears in the gear assembly 469 move and cause the first roller 464 and the second roller to rotate about their respective longitudinal axes. The gear assembly 469 is configured to rotate the first roller 464 and the second roller 465 in opposite directions. Thus, if the first roller 464 and the crank 467 rotate counterclockwise, the second roller 465 rotates clockwise.

In implementations that use the pressing assembly 460, the first moldable material 103 is placed in the recess 223. The first base portion 220 is placed on the platform with the second side 222 facing toward the platform 463 and the first side 221 facing away from the platform 463 and toward the first roller 464. The user turns the crank 467 such that the first roller 464 and the second roller 465 rotate to pull the first base portion 220 with the first moldable material 103 between the first roller 464 and the second roller 465, thereby moving the first base portion 220 in the y direction. The first roller 464 and the second roller 465 press against the first base portion 220 to flatten the first moldable material 103 into the recess 223. In particular, the first roller 464 presses against the portion 228 and the first moldable material 103 such that the first moldable material 103 spreads out and fills the recess 223.

The distance 466 is such that the rollers 464 and 465 apply pressure to the first moldable material 103 and/or the first base portion 220. In some implementations, a plate structure that is separate from the platform 463, the first base portion 220, and the second base portion 240 is positioned between the base portion 220 and the platform 463 to ensure that the distance between the first roller 464 and the second roller 465 is such that the first moldable material 103 and the first base portion 220 are squeezed between the rollers 464 and 465 so that the material 103 spreads out and fills the recess 223. For example, the first base portion 220 and the separate plate structure may stack along the z direction to form a stack that fits between the rollers 464, 465. The extent of the stack in the z direction ensures that the first base portion 220 and/or the material 103 touches the first roller 464 (or the second roller 465) and that the separate plate like structure touches the second roller 465 (or the first roller 464). The separate plate structure may help to ensure that the rollers 464, 465 apply pressure to the moldable material 103. The separate plate structure may be, for example, the third base portion 190 (FIG. 1). The separate plate structure may have the same extent in the x-y plane as the first base portion 220 and/or the second base portion 240.

The user continues to rotate the crank 467 until the first base portion 220 is no longer between the first roller 464 and the second roller 465. While the first base portion 220 is between the first roller 464 and the second roller 465, the user may turn the crank consistently in one direction such that the first base portion 220 moves through the space 466 in one direction. The user may have the option of changing the direction of rotation of the crank 467 such that the first base portion 220 is able to move in both the y and –y directions. For example, being able to change the direction of motion of the first base portion 220 allows the user to apply additional pressure to a portion of the first base portion 220 that already passed between the first roller 464 and the second roller 465.

Figure 5:
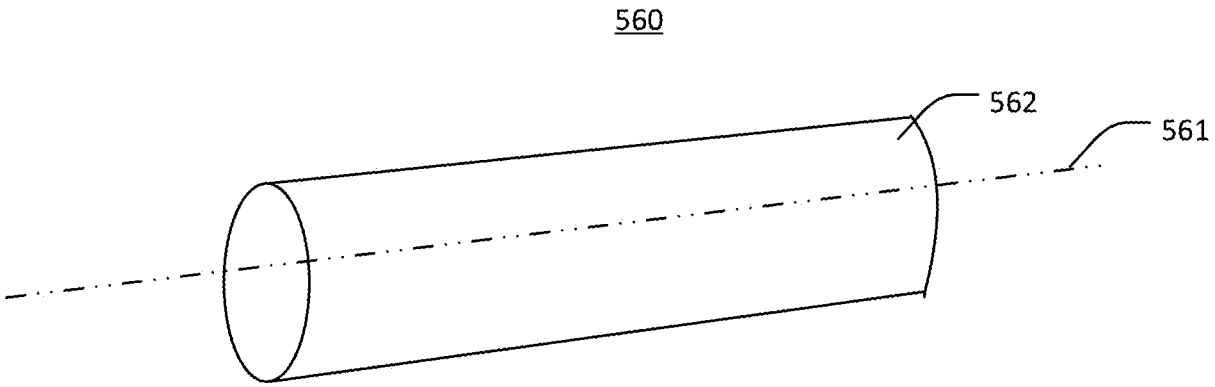

FIG. 5 is a perspective block diagram of another pressing assembly 560. The pressing assembly 560 is a cylindrical body 562 that extends along a longitudinal axis 561. The pressing assembly 560 may be used to press the first moldable material 103 into the recess 223. For example, the first moldable material 103 may be initially a lump shape or a sphere. The user places the first base portion 220 on a sturdy surface, such as a table. The user then places the first moldable material 103 into the recess 223 and applies pressure to the moldable material 103 with the pressing assembly 560. For example, the user may roll the pressing assembly 560 about the longitudinal axis 561 and against the portion 228 and the first moldable material 103 such that the material 103 spreads out into the x-y plane and fills the recess 223.

After the first moldable material 103 is flattened into the recess 223, the user may remove excess amounts of the moldable material 103 from the first base portion 220. The excess amounts of the first moldable material 103 is any material 103 that is not in the recess 223.

The second moldable material 104 is pressed into the design region 243 (320). The second moldable material 104 may be pressed into the design region 243 by the user flattening the moldable material 104 into the design formation devices 244 using their hand, the pressing assembly 460, or the pressing assembly 560. To use the pressing assembly 460, the user places the second moldable material 104 in the design region 243 and presses the second moldable material 104 such that the second moldable material 104 spreads out in the x-y plane and is pressed against the design formation devices 244. To use the pressing assembly 460 to press the second moldable material 104, the user places the second base portion 240 on the platform 463 with the design region 243 facing toward the first roller 464. The second base portion 240 may be placed directly on the platform 463 with the side 242 in direct contact with the platform, or a separate plate (such as the third base portion 190 of FIG. 1) may be placed between the side 242 and the platform 463. The separate plate ensures that the distance between the first roller 464 and the second base portion 240 is such that the second moldable material 104 is flattened against the design formation devices 244 through an interaction with the first roller 464. To use the pressing assembly 560 to press the second moldable material 104 into the design formation devices 244, the user places the second moldable material 104 in the design region 243 and presses on the material 104 to spread the material 104 in the x-y plane and press the material 104 against the design formation devices 244.

When the second moldable material 104 is pressed against the design formation devices 244, the cutting edge 245 of each device 244 cuts through the moldable material 104, and a piece of the moldable material 104 is in each open space 246. Because the second moldable material 104 is pressed into the design formation devices 244, each of the open spaces 246 may be filled with second moldable material 104.

After the second moldable material 104 is pressed into the design region 243, the user may remove excess moldable material 104 from the second base portion 240. After the excess moldable material 104 is removed, only the moldable material 104 that is captured in the open spaces 246 remains in the second base portion 240.

The design region 243 and the pressed first moldable material 103 are placed in physical contact (330). For example, the user may press the first base portion 220 and the second base portion 240 together with the design region 243 facing the recess 223 while the first moldable material 103 is in the recess 223. In other implementations, the user removes the pressed first moldable material 103 from the recess 223 prior to contacting the design region 243 to the pressed first moldable material 103.

The implementation in which the user presses the first base portion 220 and the second base portion 240 together with the design region 243 facing the recess 223 is discussed as an example. The user places the first base portion 220 and the second base portion 240 in contact with each other with the design region 243 facing the recess 223. The user places the stacked first and second base portions 220, 240 on a sturdy surface, such as a table or the platform 463. The second side 222 or the second side 242 makes contact with the sturdy surface. For example, the stacked first and second base portions 220, 240 may be placed on the platform 463 and the first roller 464 and the second roller 465 are used to press the first base portion 220 and the second base portion 240 together. The distance 466 is substantially the same as the extent of the stacked first and second base portions 220, 240 in the z direction. The user places the first and second base portions 220, 240 between the first roller 464 and the second roller 465 and applies force to the crank 467. The first roller 464 and the second roller 465 rotate and pull the stacked first and second base portions 220, 240 between the first roller 464 and the second roller 465 while pressing the first base portion 220 and the second base portion 240 together. When the first base portion 220 and the second base portion 240 are stacked along the z direction with the design region 243 facing the recess 223, the stack has an extent in the z direction that is substantially the same as the separation 466. Thus, the separate plate structure is not placed between either of the first portion 220 or the second portion 240 and the platform 463.

When the force is applied, the cutting edges 245 press into the moldable material 103 that is in the recess 223. Because the height 249 of each cutting edge 245 is less than the depth 224 of the recess 223, the cutting edge 245 does not pass all the way through the pressed first moldable material 103 that is in the recess 223 unless an excessive amount of force is applied. However, by applying pressure, the second moldable material 104 that is in the open spaces 246 presses against and adheres to the first moldable material 103. Due to the properties of the moldable materials, the pressure allows for gentle adhesion of the first moldable material 103 and the second moldable material 104 in the open spaces 246. The arrangement and characteristics of the first and second rollers 464, 465 may help to ensure that the force applied to press the first and second base portions 220, 240 together is sufficient to encourage adhesion between the first moldable material 103 and the second moldable material 104 but does not cause detrimental effects. For example, the force applied by the first roller 464 and the second roller 465 is not excessive and does not cause the first base portion 220 or the second base portion 240 to bend. The arrangement and characteristics of the first roller 464 and the second roller 465 include, for example, the extent of the distance 466 and the hardness and shape of the first and second rollers 464, 465.

The pressed first moldable material 103 and the design region 243 are separated from each other (340). For example, the second base portion 240 may be pulled away from the first base portion 220. As discussed above, the second moldable material 104 adheres to the pressed first moldable material 103. Thus, the pieces of the second moldable material 104 that are in the open spaces 246 remain on the pressed moldable material 103 after the design region 243 is separated. The pressed moldable material 103 that includes the adhered pieces of the second moldable material 104 is the printed moldable material. The pieces of the second moldable material 104 have an overall shape and arrangement that is determined by the placement of the design formation devices 244 in the design region 243. The shape of each individual piece of the second moldable material 104 is determined by the shape of the cutting edge 245 in the x-y plane.

Figure 6:
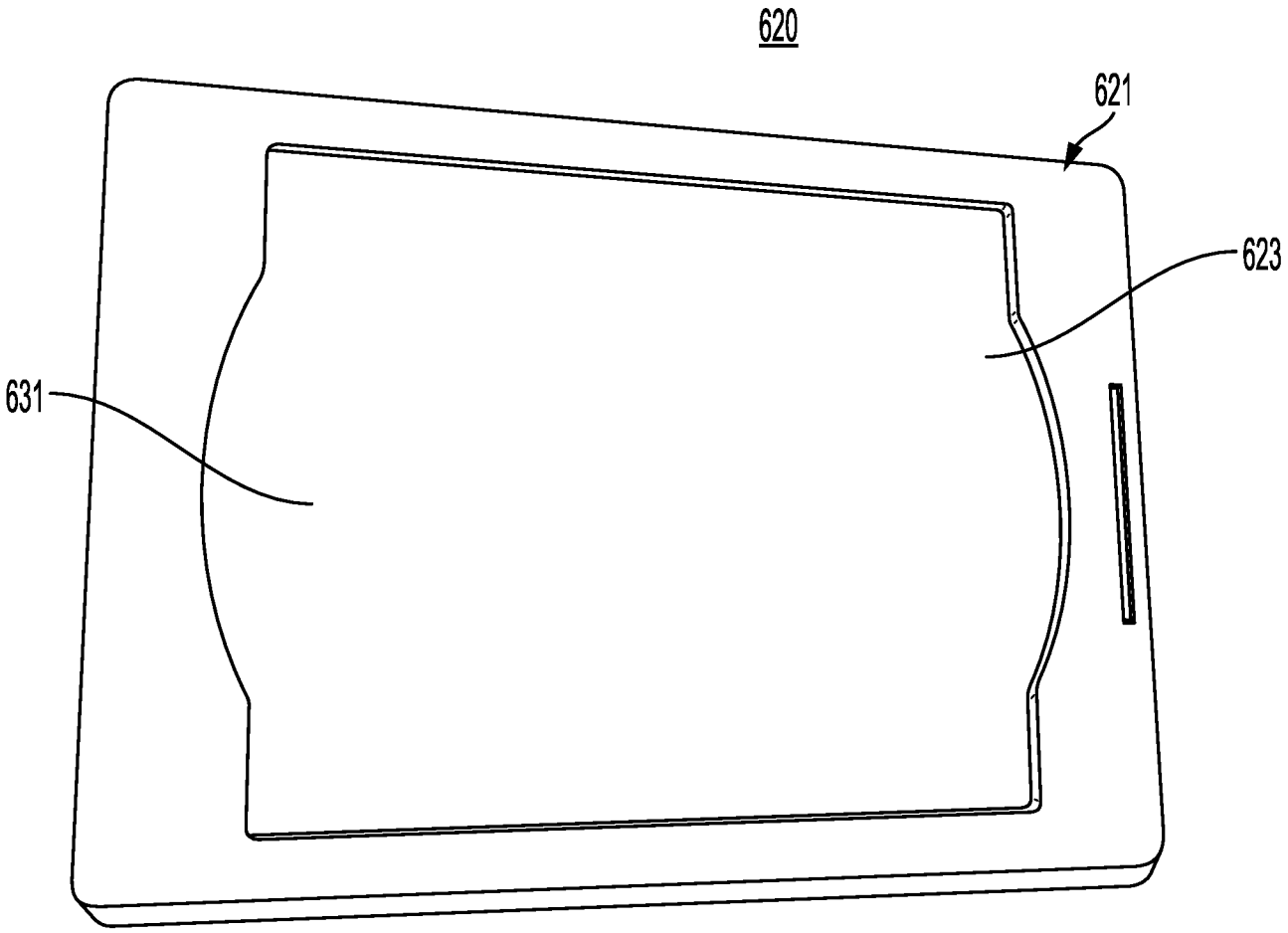
FIG. 6 is a block diagram of another example of a first base portion.

FIG. 6 is a block diagram of another first base portion 620. The first base portion 620 may be used with the second base portion 140, the second base portion 240, the pressing assembly 460, and/or the pressing assembly 560.

FIG. 6 shows a side 621 of the first base portion 620. A recess 623 is formed in the side 621 of the first base portion 620. The recess 623 is similar to the recess 223 (FIGS. 2A and 2D). However, the recess 623 includes a grabbing region 631 that extends from one end of the recess 623. The first moldable material 103 is pressed into the recess 623 as discussed above. When the first moldable material 103 is pressed into the recess 623, the first moldable material 103 is also pressed into the grabbing region 631. The pieces of the second moldable material 104 are transferred onto the pressed first moldable material 103 as discussed above. Due to the arrangement of the design formation devices 244, the transferred pieces of the second moldable material 104 are only transferred to the first moldable material 103 that is in the recess 623 and are not in the grabbing region 631. Thus, the grabbing region 631 allows the user to grab or hold the pressed moldable material 103 and pull the pressed moldable material 103 out of the recess 623 without disturbing the pieces of the second moldable material 104 that adhere to the pressed first moldable material 103.

Figure 7:
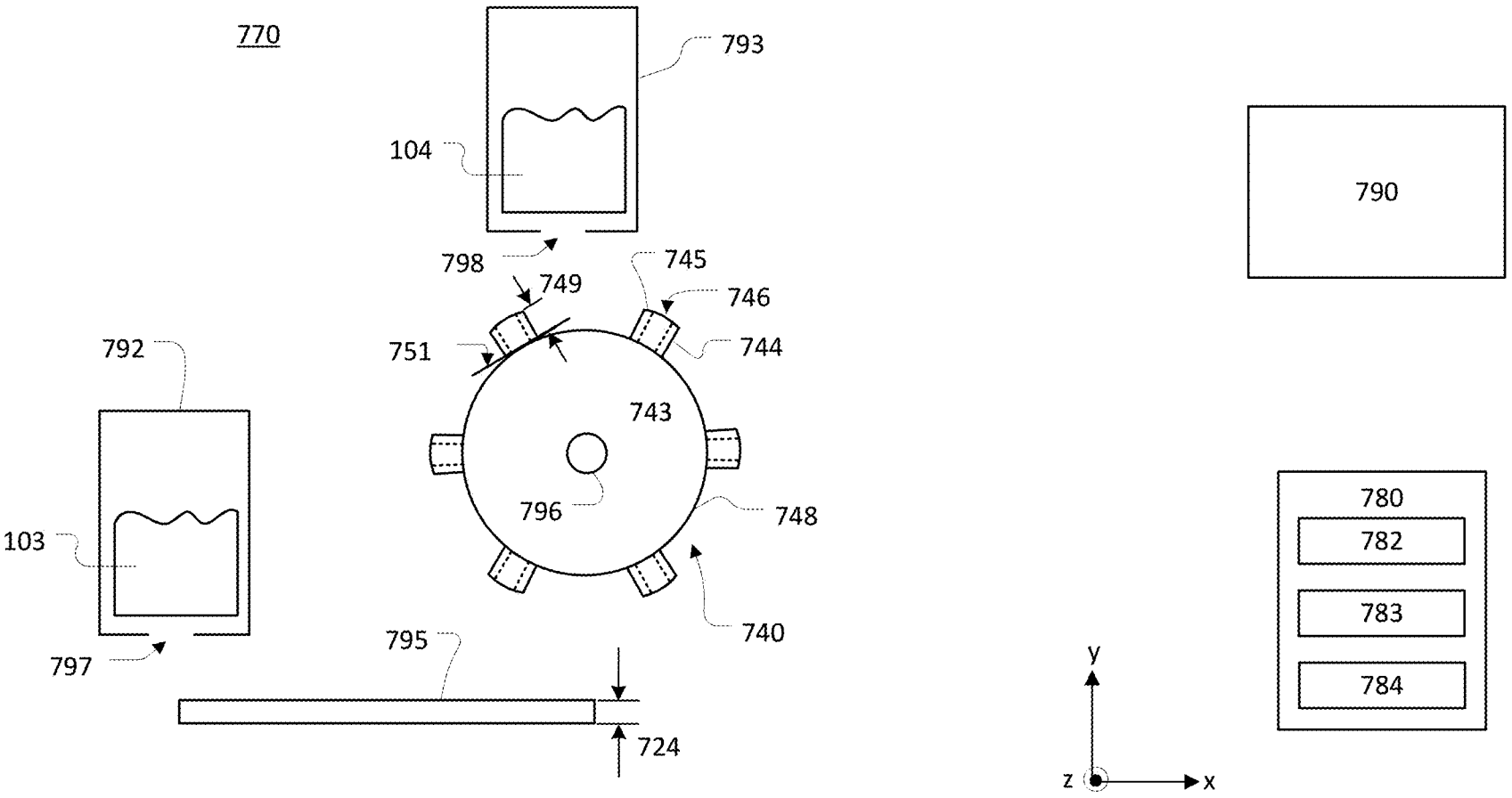
FIG. 7 is a block diagram of an example of a toy system.
Figure 9:
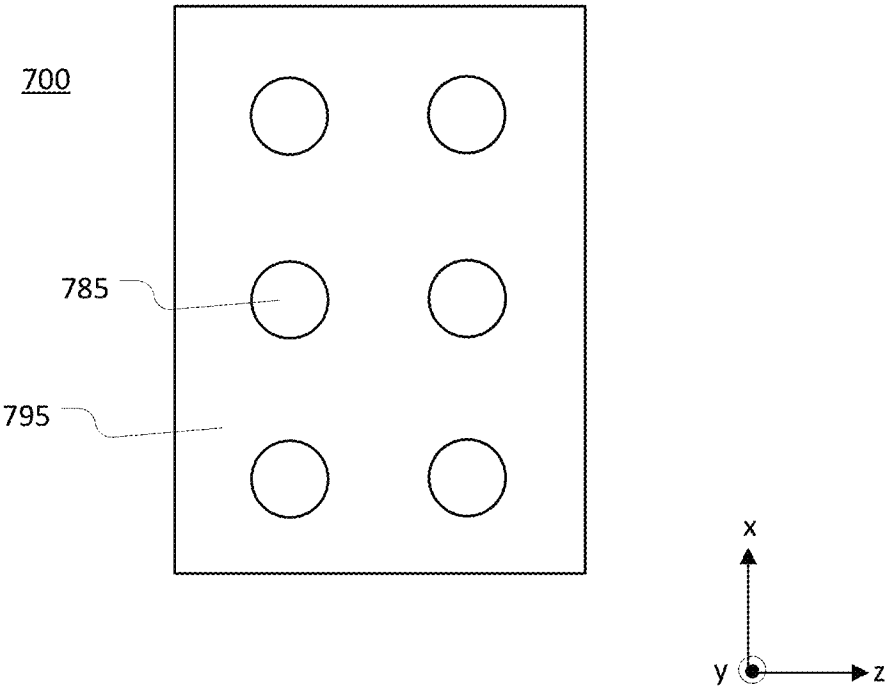
FIG. 9 is a top view of an example of a printed moldable material.

FIG. 7 is a block diagram of a toy system 770. The toy system 770 is used to make a printed moldable material 700 (FIG. 9), which includes segments of the moldable material 104 on a substrate 795. FIG. 9 is a block diagram of a top of the printed moldable material 700.

Referring to FIG. 7, the system 770 includes a design formation device 740 and the substrate 795. The substrate 795 is a flattened or substantially planar segment of the first moldable material 103. The substrate has a thickness 724 in the Y direction. As discussed below, the design formation device 740 receives the moldable material 104 from a material supply 793 and captures segments of the moldable material 104 in design projections 744. Specifically, segments of the moldable material 104 are captured in an open space 746 in each design projection 746. The design formation device 740 is then rolled over or otherwise placed into contact or interacted with the substrate 795 such that the segments of the moldable material 104 in the open spaces 746 are transferred out of the open spaces 246 and onto the substrate 795. The segments of the moldable material 104 remain on the substrate 795 to thereby produce the printed moldable material 700.

The design formation device 740 includes a base portion 743 and a plurality of design formation projections 744 that extend from an exterior surface 748 of the base portion 743. In the example shown in FIG. 7, the base portion 743 is a three-dimensional cylindrical object that extends in the Z direction (out of the page) and has a circular cross-section in the X-Y plane. Each of the design formation projections 744 includes a cutting portion 745 and an open space 746. The cutting portions 745 are similar to the cutting portions 145 and 245, and the open spaces 746 are similar to the open spaces 146 and 246. The design formation projections 744 extend radially outward from the exterior surface 748 to a height 749. Each height 749 is the distance from the exterior surface 748 and a tangent 751 to the exterior surface 748 at that design formation projection 744. The thickness 724 is less than the height 749. The design formation projections 744 may be arranged in any manner on the exterior surface 748. For example, the design formation projections 744 may form a rectilinear array, a random pattern, or any other spatial arrangement. Moreover, the design projections 744, the cutting portions 745, and the open spaces 746 may have any shape in a plane perpendicular to the radial direction.

The toy system 770 also includes a first material supply 792, the second material supply 793, a driving device 790, and a control system 780. The first material supply 792 and the second material supply 793 are, for example, hoppers, tanks, or any other type of container capable of holding moldable material. The first material supply 792 includes an opening 797, and the second material supply 793 includes an opening 798. The openings 797 and 798 pass through the respective material supplies 792 and 793. Thus, the moldable material 103, 104 is able to pass through the openings 797, 798, respectively. The first material supply 792 and the second material supply 793 may include additional elements. For example, either or both of the supplies 792 and 792 may include a plate or block that applies pressure to the respective moldable material 103 and 104 to cause the moldable material 103 and 104 to pass through the respective openings 797, 798.

In some implementations, the first moldable material 103 is extruded or formed into the substrate 795 by being extruded through the opening 797. In other implementations, the toy system 770 lacks the first material supply 792, and the substrate 795 is provided as a pre-formed substrate 795. In still other implementations, the first material supply 792 is a canister that contains the moldable material 103, and the user forms the substrate 795 using a base portion such as the base portion 120 (FIG. 1) or by applying the pressing assembly 560 (FIG. 5) to the moldable material 103 with or without using the base portion 120.

The control system 780 that controls a driving device 790. The driving device 790 is coupled to the design formation device 740. The driving device 790 may be, for example, a motor that converts electrical power to mechanical power and causes the base portion 743 to rotate about the Z axis.

In the example of FIG. 7, the control system 780 is an electronic control system that includes an electronic processing module 782, a computer-readable memory module 783, and an I/O interface 784. The electronic processing module 782 includes one or more processors suitable for the execution of a computer program such as a general or special purpose microprocessor, and any one or more processors of any kind of digital computer. Generally, an electronic processor receives instructions and data from a read-only memory, a random access memory (RAM), or both. The electronic processing module 782 may include any type of electronic processor. The electronic processor or processors of the electronic processing module 782 execute instructions and access data stored on the memory module 783. The electronic processor or processors are also capable of writing data to the memory module 783.

The memory module 783 may be volatile memory, such as RAM, or non-volatile memory. In some implementations, the memory module 783 includes non-volatile and volatile portions or components. The memory module 783 may store data and information that is used in the operation of the design formation device 740. For example, the memory module 783 may store information that relates to the speed and/or direction at which the base portion 743 rotates.

The I/O interface 784 is any kind of interface that allows the control system 780 to exchange data and signals with an operator, the driving device 790, and/or an automated process running on another electronic device. For example, in implementations in which instructions stored on the memory module 783 may be edited, the edits may be made through the I/O interface 784. The I/O interface 784 may include one or more of a visual display, a keyboard, and a communications interface, such as a parallel port, a Universal Serial Bus (USB) connection, and/or any type of network interface, such as, for example, Ethernet. The I/O interface 784 also may allow communication without physical contact through, for example, an IEEE 802.11, Bluetooth, or a near-field communication (NFC) connection.

In implementations that include the control system 780, the toy system 770 may be used as part of an automated manufacturing process. However, the toy system 770 may be implemented without the control system 780. For example, in some implementations, the driving device 790 is a manually powered and operated driving device, such as a crank that is attached to the base portion 743.

Figure 8:
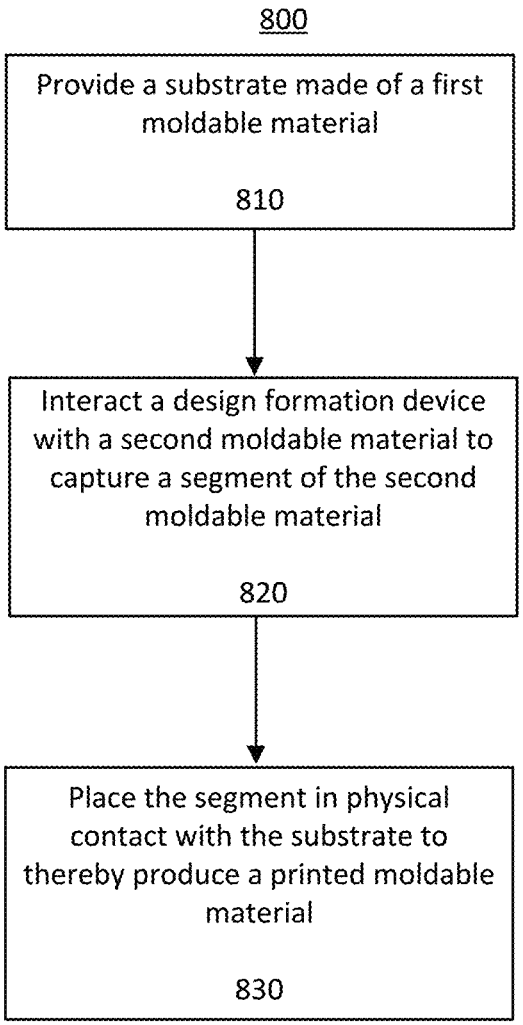
FIG. 8 is a flow chart of an example of a process for making a printed moldable material.

FIG. 8 is a flow chart of a process 800. The process 800 is used to produce the printed moldable material 700 (FIG. 9). The process 800 is performed with the toy system 770 (FIG. 7).

The substrate 795 is provided (810). For example, in some implementations, pressure is applied to the first moldable material 103 and the substrate 795 is formed by extruding the first moldable material 103 through the opening 797 of the first material supply 792. In these implementations, the opening 797 is a slot having a height that is the same as the thickness 724. In other implementations, the user forms the substrate 795 from a block or lump of the first moldable material 103 without using the supply system 792.

The design formation device 740 interacts with the second moldable material 104 to capture a segment of the second moldable material 104 (820). For example, the second moldable material 104 may be pressed through the opening 798 and onto the design formation device 740 while the design formation device 740 rotates about the Z axis. A segment or piece of the second moldable material 104 becomes lodged in each open space 746 as a result of this interaction. For example, each open space 746 may be filled with the second moldable material 104.

The segments are placed in physical contact with the substrate 795 (830). For example, after the segments are lodged in the open spaces 746, the design formation device 740 may be rolled over the substrate 795. The interaction between the substrate 795 and the segments in the open spaces 746 causes the segments to stick to the substrate 795 such that the printed moldable material 700 (FIG. 9), which includes the segments (labeled as 785), is formed. In some implementations, the printed moldable material 700 is pressed or pressure is otherwise applied to the printed moldable material 700.

Other implementations are within the scope of the claims. For example, the pressing assembly 460 may include only the first roller 464. In these implementations, pressure is applied to the first base portion 220 and/or the second base portion 240 by rolling the first base portion 220 and/or the second base portion 240 with the first roller 464. In the pressing assembly 460 shown above, the first and second rollers 464, 465 rotate relative to the platform 463 but are held in a fixed spatial location along the platform 463 by the roller support 468. In other implementations, the roller support 468 is configured to allow the first roller 464 and/or the second roller 465 to move along the y direction independently of the platform 463.

What is claimed is:

1. A toy set comprising:

a first base portion comprising a first recessed region having a first depth;

a second base portion comprising a design region, the design region comprising one or more design formation devices, each of the one or more design formation devices comprising: a design projection extending from the second base portion to a second height that is less than the first depth; and a pressing assembly configured to: press a first moldable material into the first recessed region, press a second moldable material into the design region, and press the first base portion and the second base portion together, wherein the pressing assembly comprises:

a support; and a first roller mounted to the support and configured to rotate relative to the support, wherein the first roller and the support are separated such that the first base portion or the second base portion fits between the first roller and the support.

2. The toy set of claim 1, wherein the second height is no more than half of the first depth.

3. The toy set of claim 1, wherein the pressing assembly comprises a rigid cylindrical body configured to rotate about a longitudinal axis of the body.

4. The toy set of claim 1, wherein the pressing assembly further comprises a lever connected to the first roller, and the roller rotates relative to the support in response to a force applied to the lever.

5. The toy set of claim 4, wherein the lever moves in response to the force applied to the lever, and the pressing assembly further comprises a second roller and a gear assembly configured to transfer the motion of the lever to the first roller and the second roller.

6. The toy set of claim 5, wherein the first roller and the second roller are arranged such that the first base portion and a third base portion, or the second base portion and the third base portion fit between the first roller and the second roller.

7. The toy set of claim 5, wherein the first roller and the second roller are arranged such that the first base portion and the second base portion fits between the first roller and the second roller at the same time.

8. The toy set of claim 5, further comprising a third base portion configured for placement between the support and one of the first base portion and the second base portion.

9. The toy set of claim 1, wherein the first roller and the support are separated such that the first base portion and the second base portion fit between the first roller and the support at the same time.

10. The toy set of claim 1, wherein the design region comprises more than one design formation device.

11. The toy set of claim 10, wherein all of the design projections have the same shape.

12. The toy set of claim 10, wherein the design formation devices are arranged in a regular pattern.

13. The toy set of claim 12, wherein the regular pattern comprises a rectangular grid.

14. The toy set of claim 1, further comprising the first moldable material and the second moldable material.

15. The toy set of claim 1, wherein the recessed region includes a lip portion configured to allow the first moldable material to be removed from the recessed region after the first moldable material is pressed into the recessed region.

16. The toy set of claim 1, wherein the first base portion is a first plate comprising a first side and a second side, and the first recessed region is on the first side of the first plate; and the second base portion is a second plate comprising a first side and a second side, and the design region is on the first side of the second plate.

17. The toy set of claim 16, wherein the first side of the first plate and the second side of the second plate are configured to be pressed toward each other.

18. The toy set of claim 1, wherein the first moldable material is a first piece of dough, and the second moldable material is a second piece of dough.

19. The toy set of claim 1, wherein the first moldable material is a first color, and the second moldable material is a second color that is visually distinct from the first color.

20. A toy set comprising:

a first base portion comprising a recess having a first depth;

a second base portion comprising a design region, the design region comprising one or more design formation devices, each of the one or more design formation devices comprising a design projection extending from the second base portion to a second height that is less than the first depth;

a third base portion;

a first moldable material;

a second moldable material; and a pressing assembly comprising:

a platform;

a first roller; and a second roller at the platform, wherein the second roller and the first roller are separated;

the first base portion and the third base portion, the second base portion and the third base portion, or the first base portion and the second base portion are configured to stack together to form a stack; and the stack fits between the first roller and the second roller while touching the first roller and the second roller.

21. A system comprising:

a substantially planar substrate with a thickness, wherein the substantially planar substrate comprises a first moldable material;

a design formation device comprising:

a base portion; and a plurality of design formation projections that extend from the base portion to a first height, each design formation projection comprising a cutting edge and an open space; and a material supply configured to provide a second moldable material to the design formation device to thereby capture a segment of the second moldable material in the open space of at least one design formation projection; and wherein, the thickness of the substrate is less than the first height, the first moldable material and the second moldable material are distinct moldable materials, the design formation device is configured to be placed in contact with the substantially planar substrate, and an interaction between at least one design formation projection and the substrate transfers the segment of the second moldable material in the open space to the substrate.

22. The system of claim 21, wherein the material supply is configured to hold the second moldable material and to place the second moldable material in contact with the design formation device.

23. The system of claim 21, wherein the base portion is a cylinder, and the plurality of design formation projections extend from an outer surface of the cylinder.

24. The system of claim 23, further comprising an additional material supply configured to hold the first moldable material.

25. The system of claim 24, wherein the additional material supply is further configured to shape the first moldable material into the substantially planar substrate.

26. The system of claim 21, further comprising a driving device coupled to the design formation device, the driving device configured to cause the interaction between the at least one design formation projection and the substrate.

27. The system of claim 26, wherein the driving device comprises a motor.

28. The system claim 21 wherein the first moldable material is a first piece of dough, and the second moldable material is a second piece of dough.

29. The system of claim 21, wherein the first moldable material is a first color, and the second moldable material is a second color that is visually distinct from the first color.

30. A toy set comprising:

a first base portion comprising a first recessed region having a first depth;

a second base portion comprising a design region, the design region comprising one or more design formation devices, each of the one or more design formation devices comprising a design projection extending from the second base portion to a second height that is less than the first depth; and a pressing assembly configured to: press a first moldable material into the first recessed region, press a second moldable material into the design region, and press the first base portion and the second base portion together, the pressing assembly comprising:

a support; and a first roller mounted to the support and configured to rotate relative to the support;

a second roller and a gear assembly configured to transfer the motion of the lever to the first roller and the second roller; and a lever connected to the first roller, wherein the roller moves relative to the support in response to a force applied to the lever; and the first roller and the second roller are arranged such that the first base portion and a third base portion, or the second base portion and the third base portion fit between the first roller and the second roller.

31. The toy set of claim 30, wherein the first moldable material is a first piece of dough, and the second moldable material is a second piece of dough.

32. The toy set of claim 30, wherein the first moldable material is a first color, and the second moldable material is a second color that is visually distinct from the first color.

33. The toy set of claim 30, wherein the first roller and the support are separated such that the first base portion or the second base portion fits between the first roller and the support.

34. A toy set comprising:

a first base portion comprising a first recessed region having a first depth;

a second base portion comprising a design region, the design region comprising one or more design formation devices, each of the one or more design formation devices comprising: a design projection extending from the second base portion to a second height that is less than the first depth; and a pressing assembly configured to: press a first moldable material into the first recessed region, press a second moldable material into the design region, and press the first base portion and the second base portion together, wherein the pressing assembly comprises:

a support; and a first roller mounted to the support and configured to rotate relative to the support, and a lever connected to the first roller, wherein the roller rotates relative to the support in response to a force applied to the lever, the lever moves in response to the force applied to the lever, and the pressing assembly further comprises a second roller and a gear assembly configured to transfer the motion of the lever to the first roller and the second roller, and wherein the toy set further comprises a third base portion configured for placement between the support and one of the first base portion and the second base portion.

* * * * *